US010299552B2

(12) United States Patent
Liang

(10) Patent No.: US 10,299,552 B2
(45) Date of Patent: May 28, 2019

(54) COLLAPSIBLE LUGGAGE

(71) Applicant: Sandy H. Liang, Ping-Tung Hsien (TW)

(72) Inventor: Sandy H. Liang, Ping-Tung Hsien (TW)

( * ) Notice: Subject to any disclaimer, the term of this patent is extended or adjusted under 35 U.S.C. 154(b) by 0 days.

(21) Appl. No.: 15/686,337

(22) Filed: Aug. 25, 2017

(65) Prior Publication Data

US 2019/0059537 A1 Feb. 28, 2019

(51) Int. Cl.

| | |
|---|---|
| ***A45C 5/14*** | (2006.01) |
| ***A45C 7/00*** | (2006.01) |
| ***A45C 5/03*** | (2006.01) |
| ***A45C 13/26*** | (2006.01) |
| ***A45C 13/30*** | (2006.01) |

(52) U.S. Cl.

CPC ..... *A45C 7/0036* (2013.01); *A45C 5/03* (2013.01); *A45C 5/14* (2013.01); *A45C 13/262* (2013.01); *A45C 13/30* (2013.01); *A45C 2013/267* (2013.01)

(58) Field of Classification Search

CPC ..... A45C 7/0036; A45C 5/03; A45C 5/14; A45C 13/262; A45C 13/30; A45C 2013/267

See application file for complete search history.

(56) References Cited

U.S. PATENT DOCUMENTS

| | | | | |
|---|---|---|---|---|
| 5,692,261 | A * | 12/1997 | Lops | A45D 40/26 15/185 |
| 9,604,658 | B2 * | 3/2017 | Kassab Arabo | B62B 3/025 |
| 2010/0300825 | A1 * | 12/2010 | Nordstrom | A45C 7/0036 190/107 |
| 2011/0209960 | A1 * | 9/2011 | MacLean, III | A45C 5/14 190/18 A |
| 2013/0075214 | A1 * | 3/2013 | Chi Yueh Chen | A45C 7/0054 190/18 A |
| 2017/0340076 | A1 * | 11/2017 | Liang | A45C 5/14 |

* cited by examiner

*Primary Examiner* — Tri M Mai
(74) *Attorney, Agent, or Firm* — Michael Best & Friedrich LLP

(57) ABSTRACT

A collapsible luggage includes a base, a flexible body connected to the base, a telescopic rod unit coupled to the flexible body, and a foldable support coupled to the flexible body, disposed opposite to the telescopic rod unit, and including a first support member that has a buckle member, and a second support member that has a protrusion. When the foldable support is in an unfolded state, the buckle member partially overlaps the protrusion to maintain the foldable support in the unfolded state. When a force is applied to move the foldable support from the unfolded state to the folded state against a resilient force of the buckle member, the buckle member is urged to deform resiliently so the protrusion is permitted to pass over the buckle member.

5 Claims, 13 Drawing Sheets

COLLAPSIBLE LUGGAGE

FIELD

The disclosure relates to a luggage, and more particularly to a collapsible luggage having a foldable support.

BACKGROUND

Luggages or suitcases are often used for carrying personal items or articles, and for protecting the personal items or articles from damage when subjected to an external impact force. Therefore, a conventional luggage typically includes an integrally-formed hard shell that constitutes a body of the conventional luggage. However, the conventional luggage has a fixed volume and normally occupies a considerable amount of space, which is inconvenient when it comes to storage or transport of the conventional luggage.

To resolve this issue, collapsible luggages with adjustable volume size are designed, such as those disclosed in U.S. Patent Publication No. 20050016810, and U.S. Pat. Nos. 6,604,617B2 and 7,849,984B2. A conventional collapsible luggage typically includes a bottom part which is collapsible such that a distance between opposite front and rear parts of the conventional collapsible luggage is adjustable, and a volume of the conventional collapsible luggage can be reduced.

Chinese Patent Publication No. ZL201620517522.3 discloses a collapsible luggage which includes a rigid base, a plurality of wheels, a flexible body, a telescopic rod, and a reinforcing unit. The rigid base defines a receiving space, and has two short edges and two long edges. The wheels are disposed under the rigid base. The flexible body has two side segments respectively connected to the short edges of the rigid base, and opposite front and rear edges respectively connected to the long edges of the rigid base. The telescopic rod is pivoted to one of the short edges of the rigid base, is coupled to one of the side segments of the flexible body, and is pivotable relative to the rigid base between an extended position and a folded position. The reinforcing unit is coupled to the other one of the side segments of the flexible body, and has two board portions. When the telescopic rod is pivoted to the folded position, the flexible body is collapsed with the board portions of the reinforcing unit overlapping each other, such that the telescopic rod, the flexible body, and the reinforcing unit can be accommodated in the receiving space for minimizing the volume of the collapsible luggage. However, when the telescopic rod is in the extended position and the flexible body is expanded, the board portions of the reinforcing unit are easily folded due to a lack of support, which renders the corresponding side segment of the flexible body easily collapsible.

SUMMARY

Therefore, an object of the disclosure is to provide a collapsible luggage that can alleviate at least one of the drawbacks of the prior art.

According to the disclosure, the collapsible luggage includes a rigid base, a plurality of wheel members, a flexible body, a telescopic rod unit, and a foldable support. The wheel members are disposed on a bottom surface of the rigid base. The flexible body is connected to the rigid base. The telescopic rod unit is coupled to the flexible body and is pivotable relative to the rigid base. The foldable support is coupled to the flexible body, is disposed opposite to the telescopic rod unit, and includes a first support member and a second support member.

The first support member has a first pivot portion, a first coupling portion opposite to the first pivot portion and fixedly coupled to the flexible body, a first contact surface located at the first pivot portion, and a resilient buckle member disposed adjacent to the first pivot portion.

The second support member has a second pivot portion, a second coupling portion opposite to the second pivot portion and fixedly coupled to the flexible body, a second contact surface located at the second pivot portion, and a protrusion adjacent to the second pivot portion. The second pivot portion is pivotally connected to the first pivot portion of the first support member so that pivot movement between the first and second support members moves the foldable support between an unfolded state, where the first and second support members are aligned with each other with the first and second coupling portions being away from each other and with the first and second contact surfaces contacting each other, and a folded state, where the first and second support members substantially overlap each other with the first and second coupling portions being close to each other.

When the foldable support is in the unfolded state, at least a portion of the buckle member overlaps at least a portion of the protrusion so as to maintain the foldable support in the unfolded state. When a force is applied on the foldable support to move the foldable support from the unfolded state to the folded state against a resilient force of the buckle member, the buckle member is urged to deform resiliently so that the protrusion is permitted to pass over the buckle member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
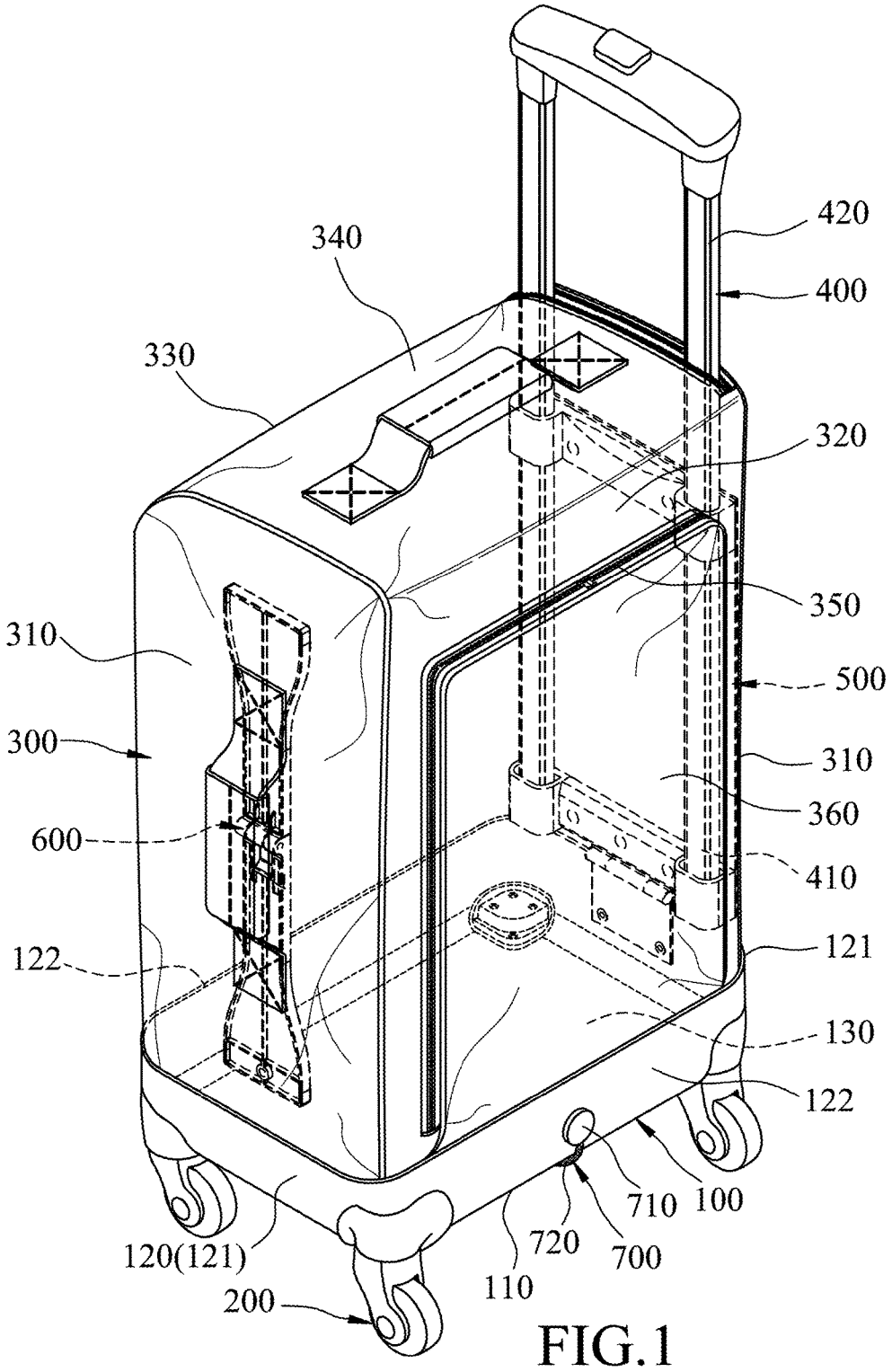
FIG. 1 is a perspective view illustrating a first embodiment of a collapsible luggage according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a collapsible luggage according to the disclosure includes a rigid base 100, four wheel members 200, a flexible body 300, a telescopic rod unit 400, a reinforcement board unit 500, a foldable support 600, and a restraining device 700.

The rigid base 100 includes a base wall 110 and a surrounding wall 120. The surrounding wall 120 extends upward from a periphery of the base wall 110 and cooperates with the base wall 110 to define a receiving space 130 which opens upward. The surrounding wall 120 has a pair of short edges 121, and a pair of long edges 122 interconnecting the short edges 121.

The wheel members 200 are disposed on a bottom surface of the rigid base 100.

The flexible body 300 is connected to the rigid base 100. The flexible body 300 has two side segments 310 that are respectively connected to the short edges 121 of the surrounding wall 120, opposite front and rear segments 320, 330 that are respectively connected to the long edges 122 of the surrounding wall 120 and that interconnect the side segments 310, and a top segment 340 that interconnects the front segment 320, the rear segment 330, and the side segments 310. The front segment 320 has a cover portion 360 that is openable through a zipper 350 that surrounds the cover portion 360.

The reinforcement board unit 500 is fixedly disposed on an inner surface of one of the side segments 310 of the flexible body 300.

The telescopic rod unit 400 is coupled to the flexible body 300 and is pivotable relative to the rigid base 100. More specifically, the telescopic rod unit 400 includes a frame 410 that is fixedly coupled to the reinforcement board unit 500 and that has a bottom end pivoted to the one of the side segments 310 of the flexible body 300 on which the reinforcement board unit 500 is disposed, and a handle 420 that is extendable and retractable relative to the frame 410.

Referring to FIGS. 2, 3, 4, 6, 7, and 8, the foldable support 600 is coupled to the other one of the side segments 310 of the flexible body 300, is disposed opposite to the telescopic rod unit 400, and includes a first support member 10 and a second support member 20.

The first support member 10 has a first pivot portion 11, a first coupling portion 12 opposite to the first pivot portion 11 and fixedly coupled to the flexible body 300, a first contact surface 13 located at the first pivot portion 11, a groove 14 extending from the first contact surface 13 toward the first coupling portion 11, and a resilient buckle member 15 disposed in the groove 14 and being adjacent to the first pivot portion 11.

The groove 14 is defined by a groove bottom surface 141 to which the groove 14 terminates and to which the buckle member 15 is connected, and two spaced-apart groove side surfaces 142 which are connected between the first contact surface 13 and the groove bottom surface 141.

The buckle member 15 has a fixed end part 151 that is connected to the groove bottom surface 141, and a free end part 152 that is opposite to the fixed end part 151, and that is resiliently movable relative to the fixed end part 151. The buckle member 15 further has a first side surface 153, a second side surface 154, and two lateral surfaces 155. The first side surface 153 extends between the fixed end part 151 and the free end part 152. The second side surface 154 extends between the fixed end part 151 and the free end part 152, and is opposite to the first side surface 153. The lateral surfaces 155 extend between the fixed end part 151 and the free end part 152, interconnect the first and second side surfaces 153, 154, and are perpendicular to the first and second side surfaces 153, 154. Each of the lateral surfaces 155 and a respective one of the groove side surfaces 142 cooperatively define a clearance therebetween.

The second support member 20 has a second pivot portion 21, a second coupling portion 22 opposite to the second pivot portion 21 and fixedly coupled to the flexible body 300, a second contact surface 23 located at the second pivot portion 21, and a protrusion 24 adjacent to the second pivot portion 21. The second pivot portion 21 is pivotally connected to the first pivot portion 11 of the first support member 10 so that pivot movement between the first and second support members 10, 20 about a pivot axis (L) moves the foldable support 600 between an unfolded state (see FIGS. 2 and 4), where the first and second support members 10, 20 are aligned with each other with the first and second coupling portions 12, 22 being away from each other and with the first and second contact surfaces 13, 23 contacting each other, and a folded state (see FIGS. 6 and 8), where the first and second support members 10, 20 substantially overlap each other with the first and second coupling portions 12, 22 being close to each other.

The protrusion 24 has a connecting end part 241 that is connected to the second pivot portion 21, a protruding end part 242 that extends from the connecting end part 241 away from the second pivot portion 21 to terminate at a protruding end surface 244, and opposite protrusion side surfaces 243 that extend between the connecting end part 241 and the protruding end part 242.

When the foldable support 600 is in the unfolded state, the protrusion 24 protrudes from the second pivot portion 21 of the second support member 20 toward the groove bottom surface 141, and each of the protrusion side surfaces 243 faces a respective one of the groove side surfaces 142 and cooperates with the respective one of the groove side surfaces 142 to define a clearance therebetween.

Figure 4:
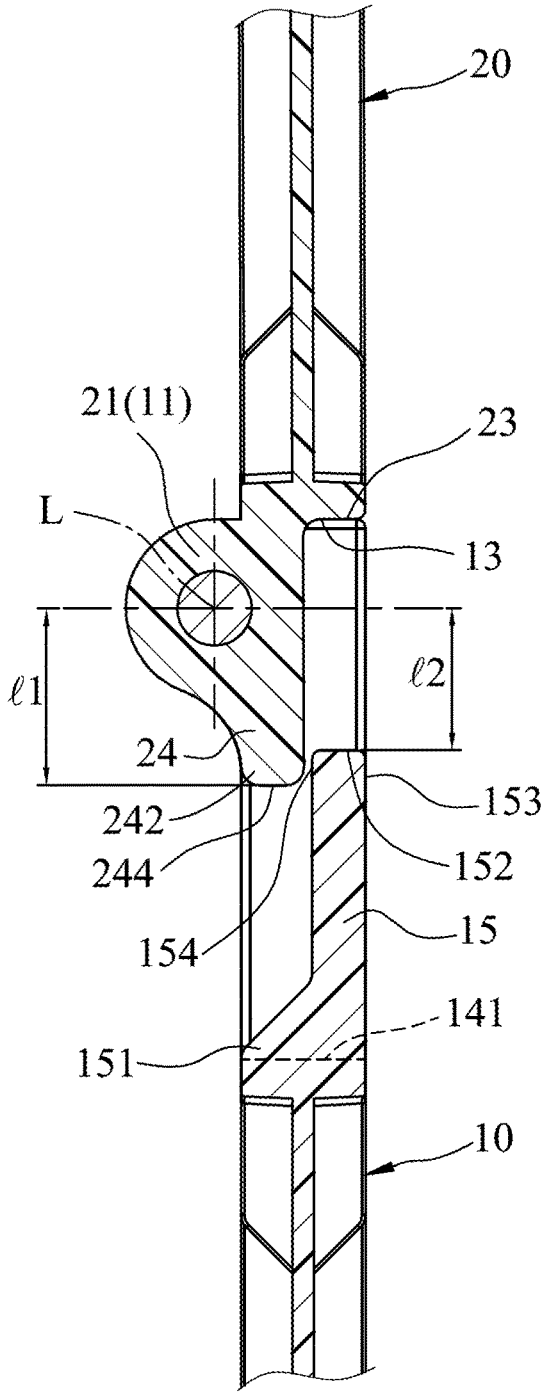
FIG. 4 is a fragmentary sectional view of the foldable support taken along line IV-IV in FIG. 2.

The free end part 152 of the buckle member 15 is configured to be located between the groove bottom surface 141 and the axis (L). As shown in FIG. 4, when the foldable support 600 is in the unfolded state, a distance (□1) between the protruding end surface 244 and an imaginary plane which is perpendicular to the foldable support 600 and along which the axis (L) extends is longer than a distance (□2) between an end surface of the free end part 152 of the buckle member 15 and the imaginary plane.

Figure 5:
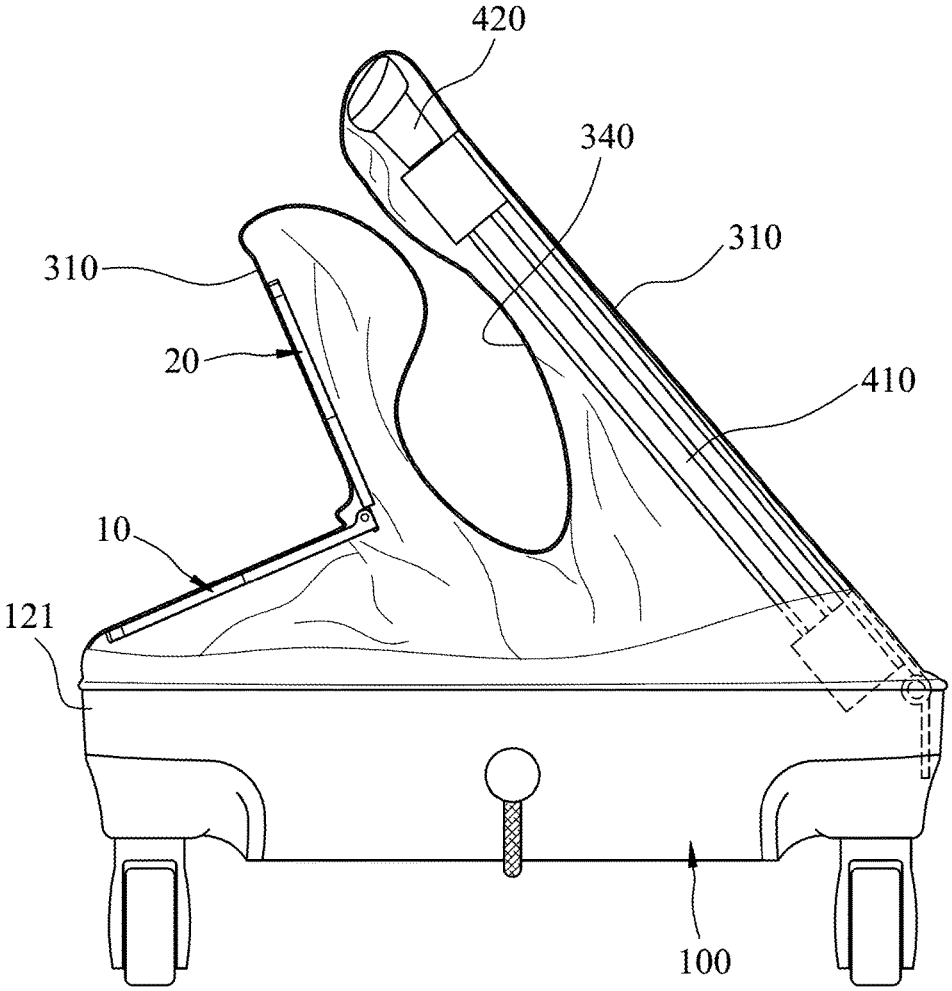
FIG. 5 is a partly sectional view illustrating the first embodiment being transformed to a collapsed state.
Figure 10:
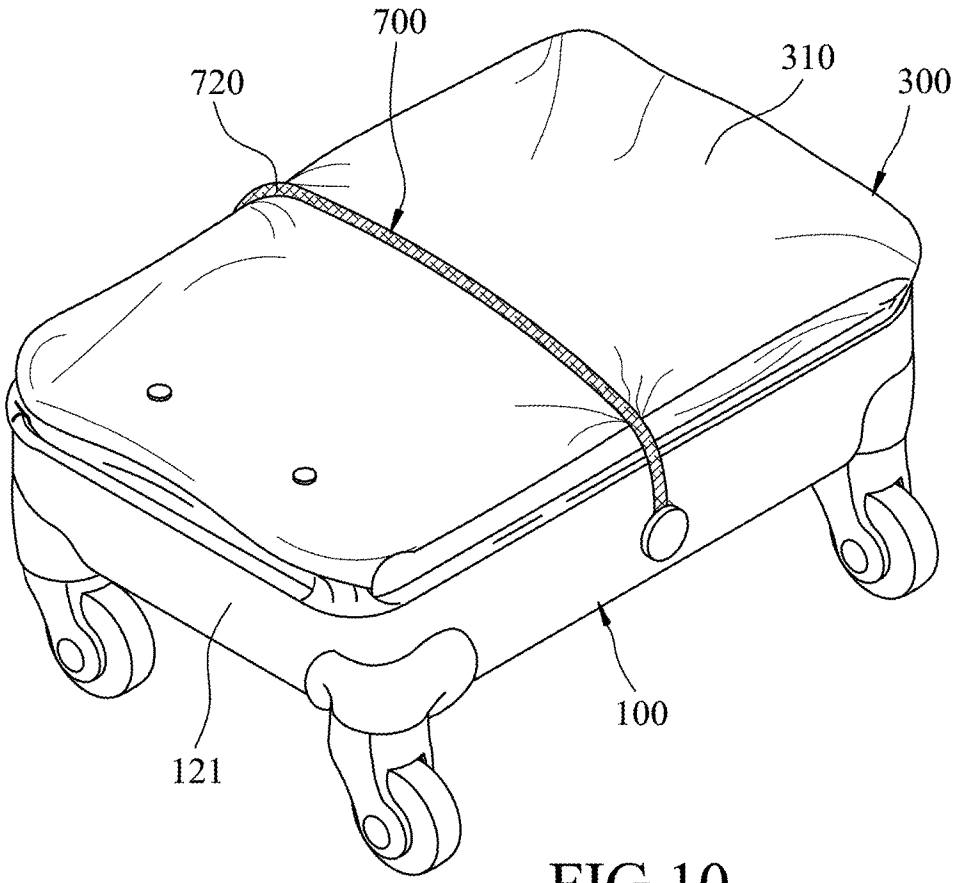
FIG. 10 is a perspective view of the first embodiment in the collapsed state.

Referring to FIGS. 5 and 10, the restraining unit includes two fixation seats 710 (only one is shown in FIGS. 5 and 10) and an elastic strip 720. The fixation seats 710 are opposite to each other and are rotatably mounted on the surrounding wall 120 of the rigid base 100. The elastic strip 720 interconnects the fixation seats 710. The fixation seats 710 are rotatable along with the elastic strip 720 relative to the rigid base 100 so that the elastic strip 720 can be operated to flip to a top surface of the rigid base 100 in an unobstructed and convenient manner.

Figure 2:
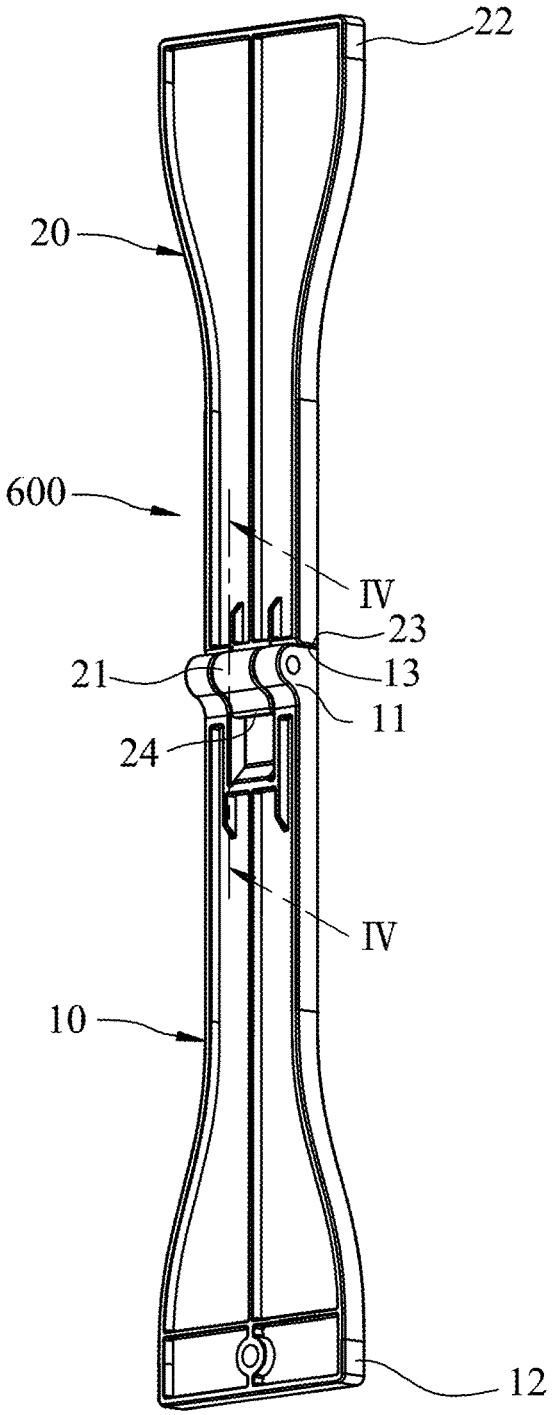
FIG. 2 is a perspective view of a foldable support of the first embodiment in an unfolded state.
Figure 3:
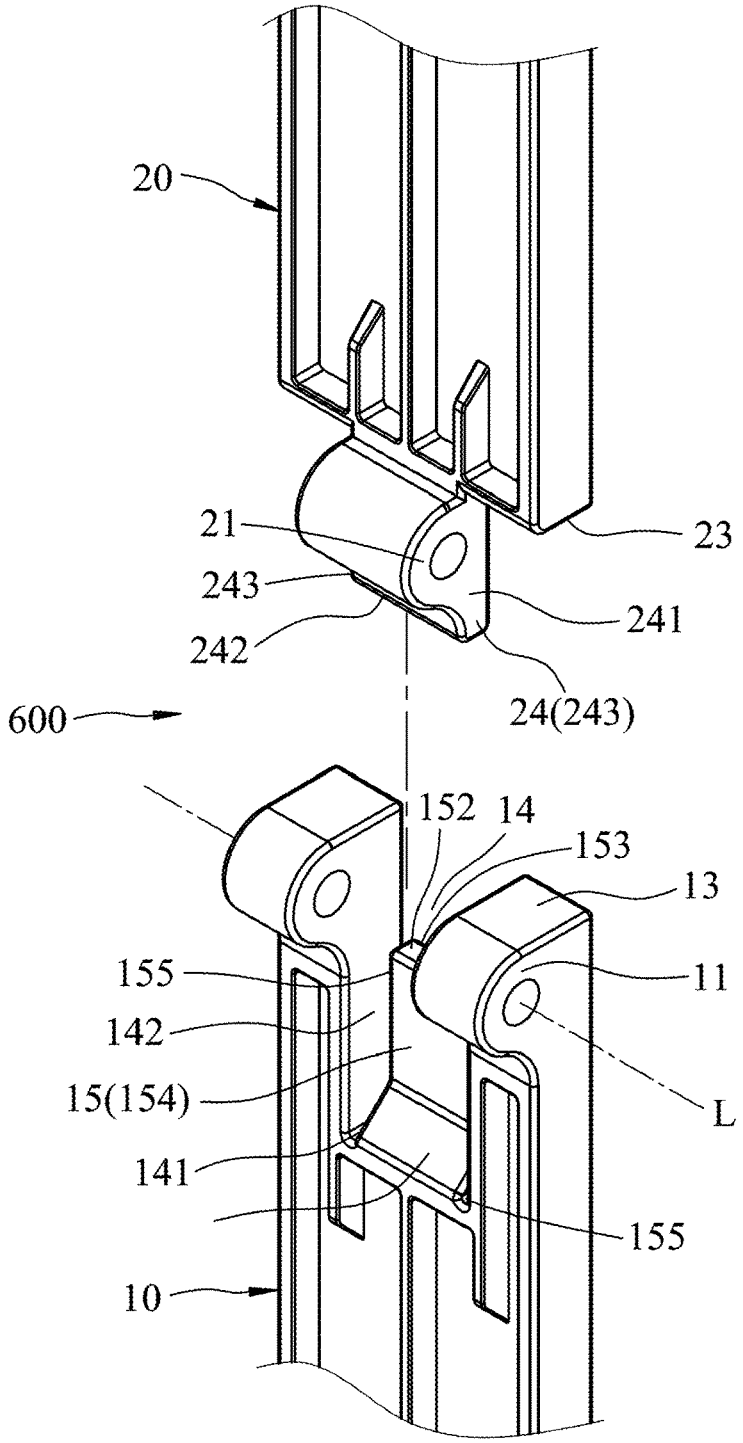
FIG. 3 is a fragmentary exploded perspective view of the foldable support of the first embodiment.

Referring to FIGS. 1, 2, and 4, when the foldable support 600 is in the unfolded state, the second side surface 154 of the buckle member 15 of the first support member 10 faces the protruding end part 242 of the protrusion 24 of the second support member 20, and the free end part 152 of the buckle member 15 overlaps the protruding end part 242 of the protrusion 24 so as to maintain the foldable support 600 in the unfolded state. As such, when the foldable support 600 is transformed to the unfolded state and when the telescopic rod unit 400 is pivoted to be substantially upright with respect to the rigid base 100, the flexible body 300 is expanded to transform the collapsible luggage to an expanded state with the one of the side segments 310 of the flexible body 300, which is supported by the foldable support 600, being not easily collapsed. At this time, the elastic strip 720 is in contact with the bottom surface of the rigid base 100 due to the elastic force of the elastic strip 720, and the handle 420 can be extended out of the frame 410, so as to facilitate carriage of the collapsible luggage.

Figure 6:
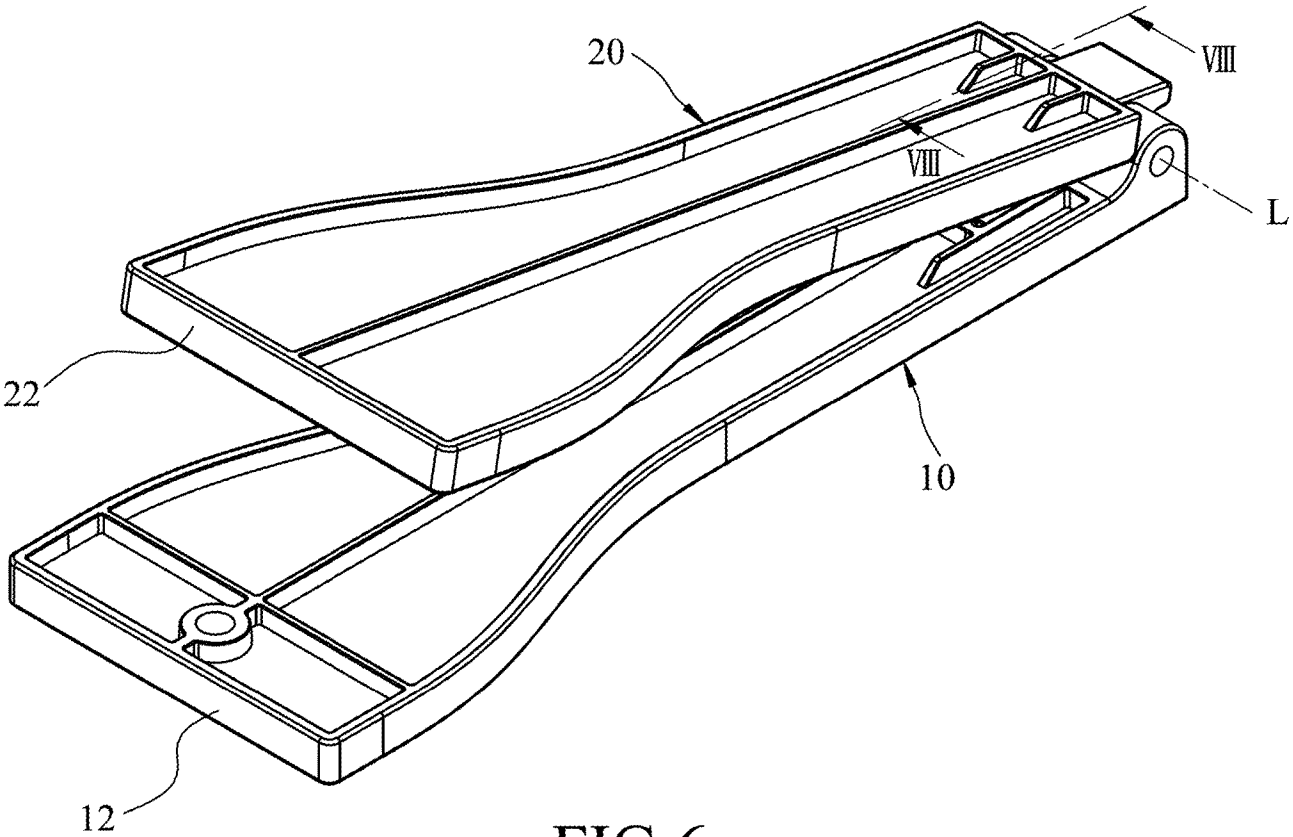
FIG. 6 is a perspective view illustrating the foldable support of the first embodiment in a folded state.
Figure 7:
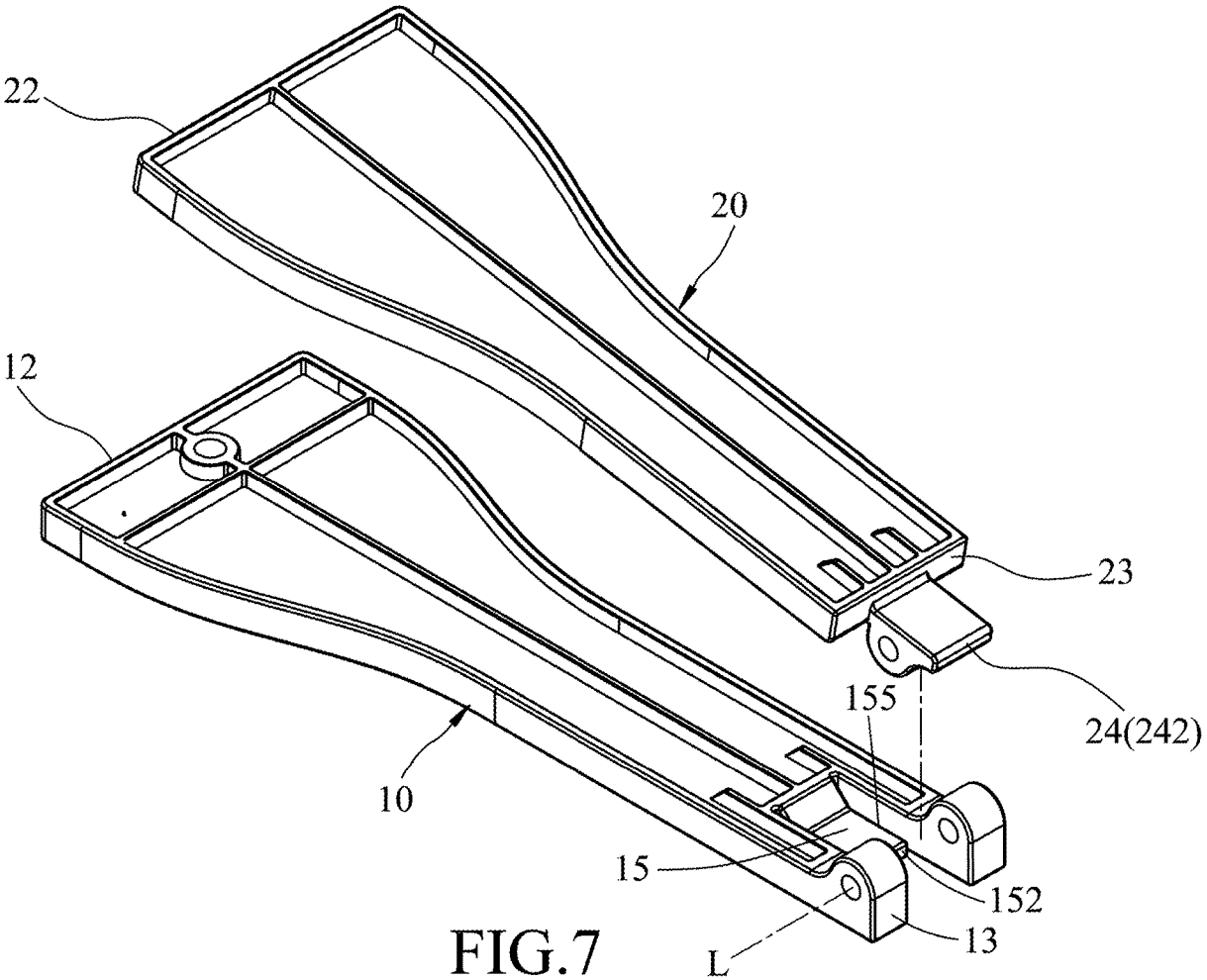
FIG. 7 is an exploded perspective view of the foldable support of the first embodiment.
Figure 8:
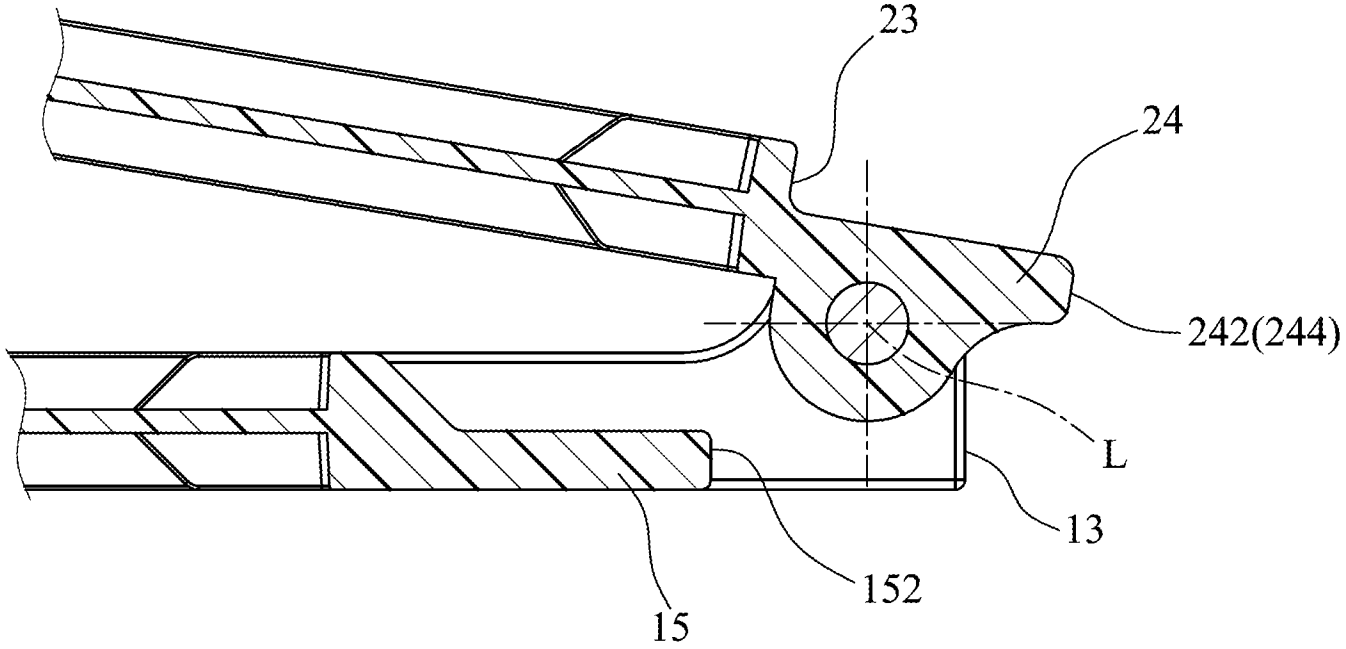
FIG. 8 is a fragmentary sectional view of the foldable support of the first embodiment.
Figure 9:
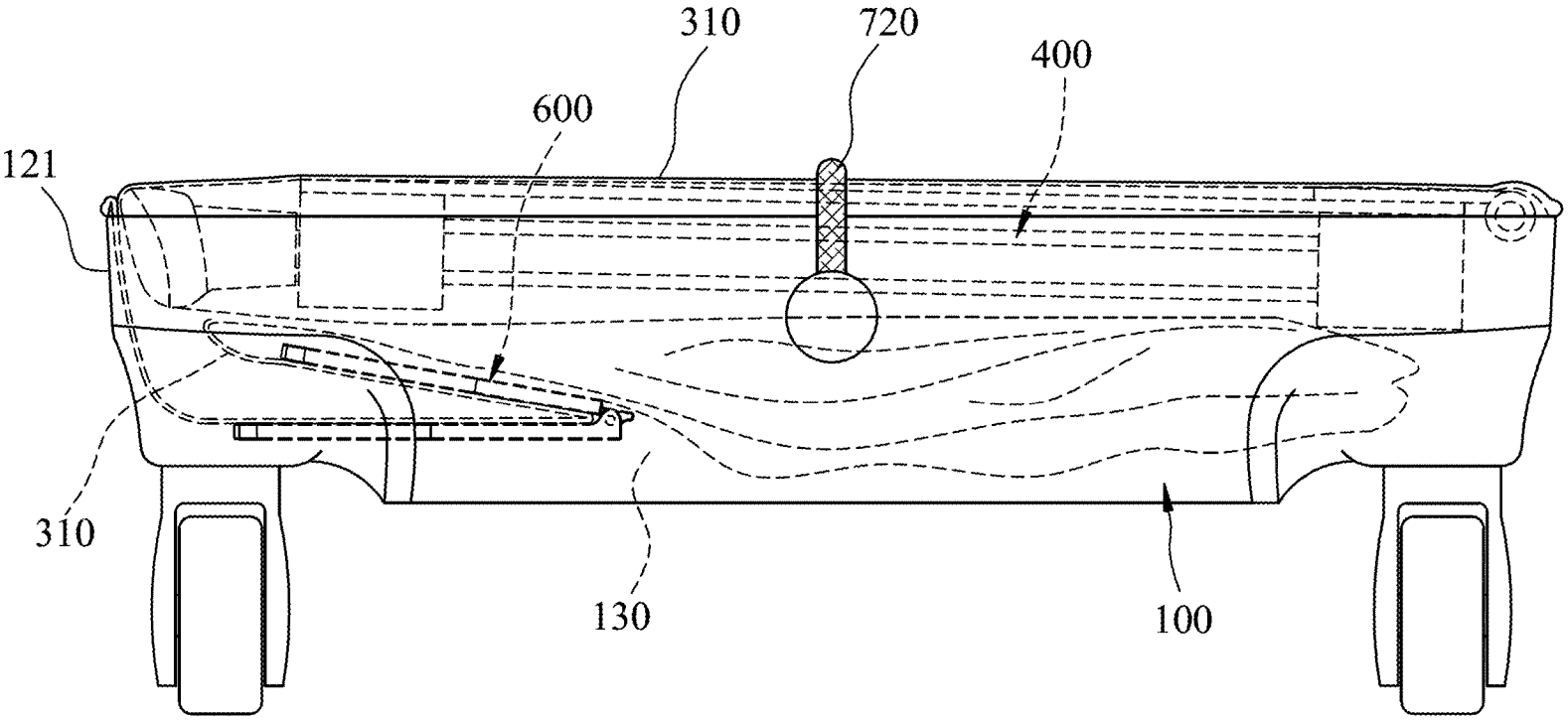
FIG. 9 is a schematic side view of the first embodiment in the collapsed state.

Referring to FIGS. 5, 6, and 8, when it is desired to transform the collapsible luggage to a collapsed state, first the handle 420 of the telescopic rod unit 400 is retracted into the frame 410, and then a user can apply a force to the foldable support 600 to transform the foldable support 600 from the unfolded state to the folded state against a resilient force of the buckle member 15. During such transformation, the buckle member 15 is urged to deform resiliently, so that the protruding end part 242 of the protrusion 24 is permitted to pass over the free end part 152 of the buckle member 15, and that the first and second support members 10, 20 can be pivoted toward each other until the first and second support members 10, 20 substantially overlap each other. At this time, the first and second contact surfaces 13, 23 are away from each other, and the free end part 152 of the buckle member 15 is away from the protruding end part 242 of the protrusion 24. As shown in FIGS. 9 and 10, the one of the side segments 310 of the flexible body 300 which is coupled to the foldable support 600 is collapsed after the foldable support 600 is transformed to the folded state. Afterwards, the entire flexible body 300 and the telescopic rod unit 400 can be folded and received in the receiving space 130. More specifically, the telescopic rod unit 400 is pivoted to a position that is flush with a top surface of the rigid base 100. At this time, the flexible body 300 is completely collapsed to transform the collapsible luggage to the collapsed state to achieve a minimum size. The elastic strip 720 can be flipped to the top surface of the rigid base 100 so as to restrain the flexible body 300 and the telescopic rod unit 400 in the receiving space 130.

When it is desired to transform the collapsible luggage back to the expanded state, first the elastic strip 720 is flipped to be in contact with the bottom surface of the rigid base 100, and the telescopic rod unit 400 is pivoted to be upright relative to the rigid base 100. Afterwards, the first and second support members 10, 20 are reversely pivoted relative to each other about the pivot axis (L) to transform the foldable support 600 to the unfolded state and to expand the flexible body 300 with the free end part 152 of the buckle member 15 being forced to pass over the protruding end part 242 of the protrusion 24, so as to maintain the foldable support 600 in the unfolded state.

In summary, by virtue of the configurations of the first and second support members 10, 20, and by virtue of the buckle member 15 and the protrusion 24 partially overlapping when the foldable support 600 is in the unfolded state, the foldable support 600 can stably support the respective side segment 310 of the flexible body 300 such that the respective side segment 310 does not collapse easily. In addition, the foldable support 600 has a simple structure, is easy to be manufactured, and can be easily operated.

Figure 11:
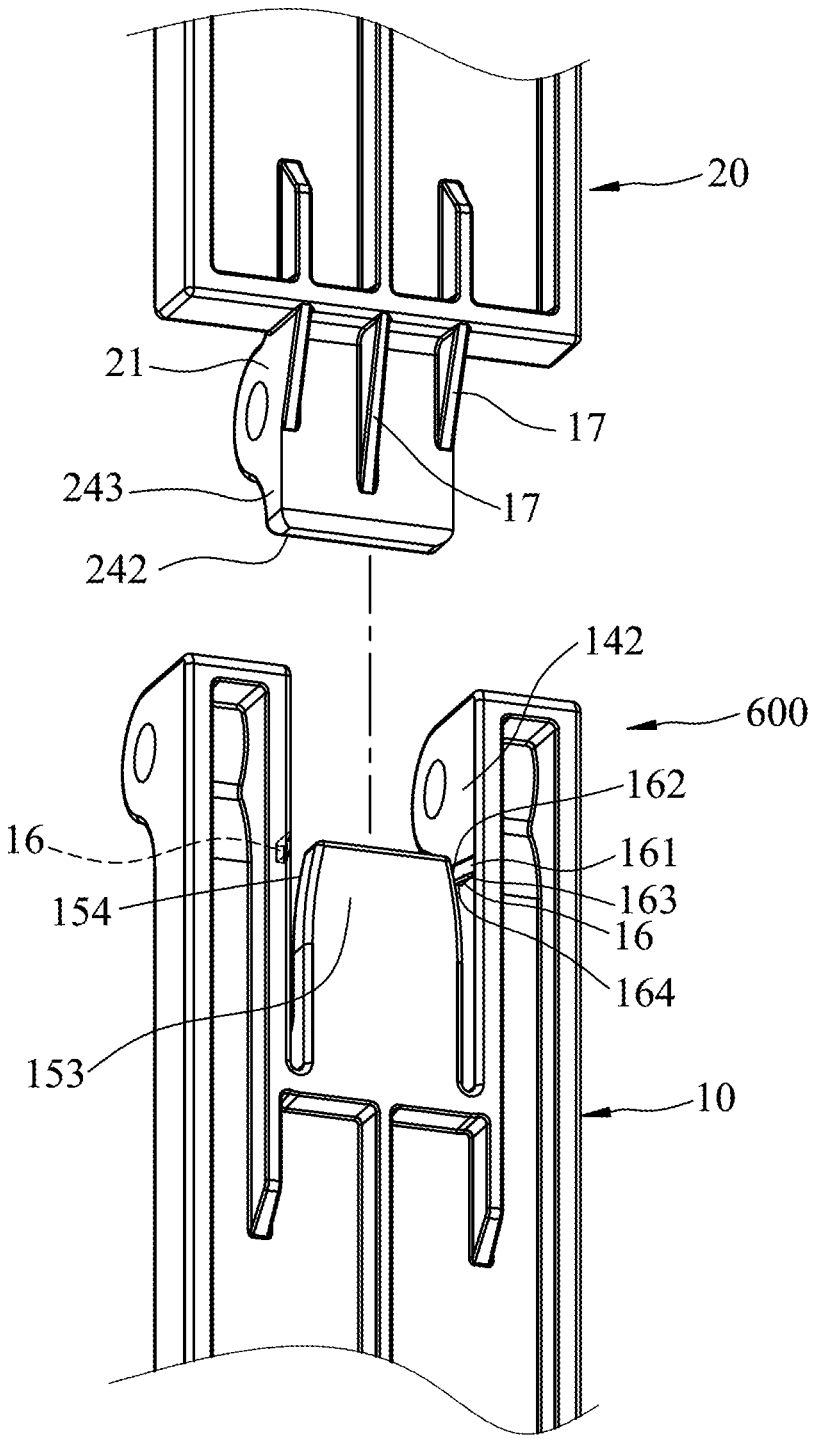
FIG. 11 is a fragmentary exploded perspective view illustrating a foldable support of a second embodiment of the collapsible luggage according to the disclosure.
Figure 12:
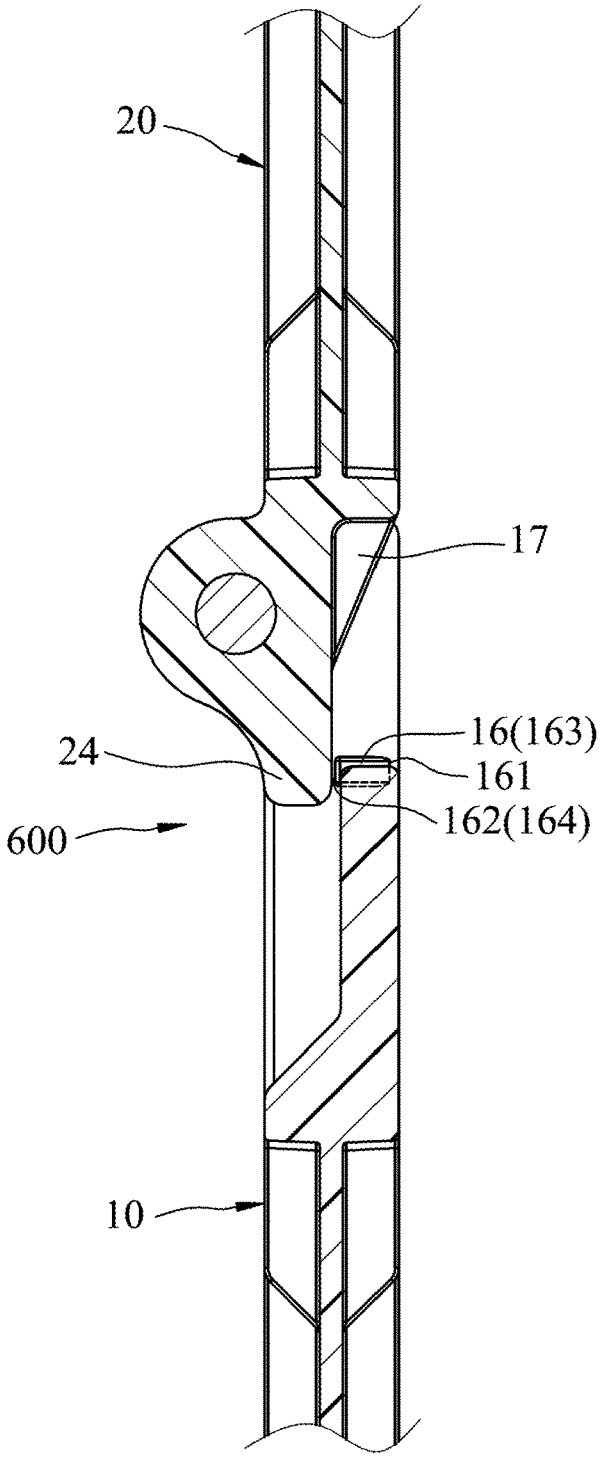
FIG. 12 is a fragmentary sectional view illustrating the foldable support of the second embodiment in an unfolded state.
Figure 13:
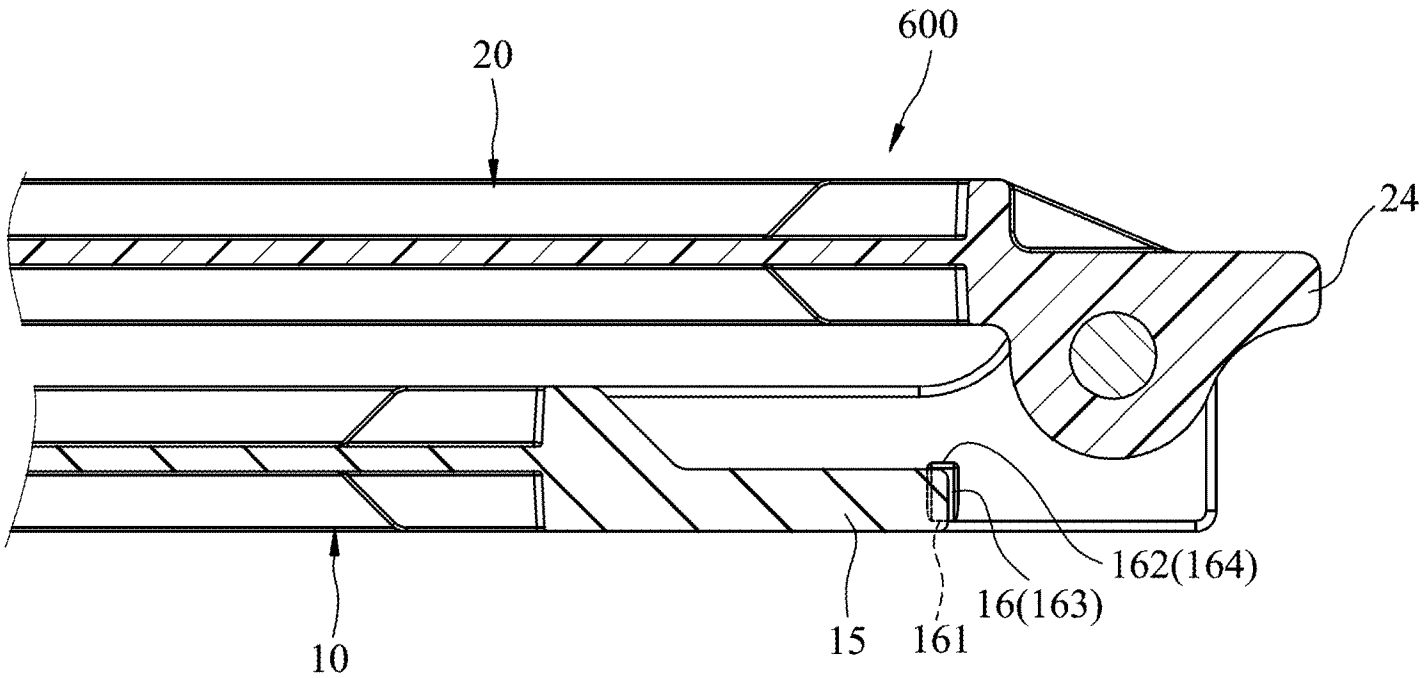
FIG. 13 is a fragmentary sectional view illustrating the foldable support of the second embodiment in a folded state.

Referring to FIGS. 11 to 13, a second embodiment of the collapsible luggage according to the disclosure is similar to the first embodiment, the difference resides in that, in the second embodiment, the first support member 10 further has two protruding blocks 16 respectively protruding from the groove side surfaces 142 toward the buckle member 15, and that the second support member 20 further has a plurality of spaced-apart reinforcement ribs 17 extending from the second pivot portion 21 to the protruding end part 242 of the protrusion 24. Each of the protruding blocks 16 has a contact end 161 and a distal end 162 that are opposite to each other and that correspond respectively in position to the first and second side surfaces 153, 154 of the buckle member 15, an inclined surface 163 that extends from the contact end 161 to the distal end 162, and a stop surface 164 that is formed at the distal end 162 and that is connected between the inclined surface 163 and a respective one of the groove side surfaces 142.

When the foldable support 600 is transformed from the folded state to the unfolded state, the protruding end part 242 of the protrusion 24 is guided by the inclined surfaces 163 of the protruding blocks 16 to pass over the protruding blocks 16. When the foldable support 600 is in the unfolded state, the protruding end part 242 of the protrusion 24 abuts against the stop surfaces 164 of the protruding blocks 16 so as to stably maintain the foldable support 600 in the unfolded state.

The structural strength of the protrusion 24 is enhanced by the reinforcement ribs 17, and thus the protrusion 24 is not easily damaged when passing over the buckle member 15 and the protruding blocks 16 during transformation of the foldable support 600 between the folded and unfolded states. Alternatively, the first support member 10 may have only one protruding block 16.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A collapsible luggage comprising:

a rigid base;

a plurality of wheel members disposed on a bottom surface of said rigid base;

a flexible body connected to said rigid base;

a telescopic rod unit coupled to said flexible body and pivotable relative to said rigid base; and a foldable support coupled to said flexible body, disposed opposite to said telescopic rod unit, and including a first support member that has a first pivot portion, a first coupling portion opposite to said first pivot portion and fixedly coupled to said flexible body, a first contact surface located at said first pivot portion, and a resilient buckle member disposed adjacent to said first pivot portion, and a second support member that has a second pivot portion, a second coupling portion opposite to said second pivot portion and fixedly coupled to said flexible body, a second contact surface located at said second pivot portion, and a protrusion adjacent to said second pivot portion, said second pivot portion being pivotally connected to said first pivot portion of said first support member so that pivot movement between said first and second support members moves said foldable support between an unfolded state, where said first and second support members are aligned with each other with said first and second coupling portions being away from each other and with said first and second contact surfaces contacting each other, and a folded state, where said first and second support members substantially overlap each other with said first and second coupling portions being close to each other;

wherein, when said foldable support is in the unfolded state, at least a portion of said buckle member overlaps at least a portion of said protrusion so as to maintain said foldable support in the unfolded state;

wherein, when a force is applied on said foldable support to move said foldable support from the unfolded state to the folded state against a resilient force of said buckle member, said buckle member is urged to deform resiliently so that said protrusion is permitted to pass over said buckle member, wherein said buckle member has a fixed end part, and a free end part that is opposite to said fixed end part, that overlaps said at least a portion of said protrusion when said foldable support is in the unfolded state, and that is resiliently movable relative to said fixed end part, wherein said protrusion has a connecting end part that is connected to said second pivot portion of said second support member, and a protruding end part that extends from said connecting end part away from said second pivot portion to terminate at a protruding end surface;

wherein said first support member and second support member are pivotable relative to each other about an axis;

wherein, when said foldable support is in the unfolded state, a distance between said protruding end surface and an imaginary plane which is perpendicular to said foldable support and along which the axis extends is longer than a distance between an end surface of said free end part of said buckle member and the imaginary plane;

wherein said free end part of said buckle member overlaps said protruding end part of said protrusion when said support member is in the unfolded state, said free end part of said buckle member passing over said protruding end part of said protrusion when said foldable support is moved from the unfolded state to the folded state;

wherein said first support member of said foldable support further has a groove extending from said first contact surface toward said first coupling portion, and defined by a groove bottom surface to which said groove terminates and to which said fixed end part of said buckle member is connected, and two spaced-apart groove side surfaces which are connected between said first contact surface and said groove bottom surface;

wherein said free end part of said buckle member is located between said groove bottom surface and the axis; and wherein said buckle member further has a first side surface extending between said fixed end part and said free end part, a second side surface extending between said fixed end part and said free end part, opposite to said first side surface, and facing said protruding end part of said protrusion of said second support member when said foldable support is in the unfolded state, and two lateral surfaces extending between said fixed end part and said free end part, and interconnecting said first and second side surfaces, each of said lateral surfaces and a respective one of said groove side surfaces cooperatively defining a clearance therebetween.

2. The collapsible luggage as claimed in claim 1, wherein:

said protrusion protrudes from said second pivot portion of said second support member toward said groove bottom surface of said groove when said foldable support is in the unfolded state, and further has opposite protrusion side surfaces that extend between said connecting end part and said protruding end part; and when said foldable support is in the unfolded state, each of said protrusion side surfaces faces a respective one of said groove side surfaces and cooperates with the respective one of said groove side surfaces to define a clearance therebetween.

3. The collapsible luggage as claimed in claim 1, wherein:

said first support member further has at least one protruding block protruding from one of said groove side surfaces; and when said foldable support is in the unfolded state, said protruding end part of said protrusion abuts against said at least one protruding block.

4. The collapsible luggage as claimed in claim 3, wherein said at least one protruding block has a contact end and a distal end that are opposite to each other and that correspond respectively in position to said first and second side surfaces of said buckle member, an inclined surface that extends from said contact end to said distal end, and a stop surface that is formed at said distal end and that is connected between said inclined surface and the one of said groove side surfaces, said protruding end part of said protrusion abutting against said stop surface when said foldable support is in the unfolded state.

5. The collapsible luggage as claimed in claim 1, wherein:

said base includes a base wall, and a surrounding wall that extends upward from a periphery of said base wall, that has a pair of short edges and a pair of long edges interconnecting said short edges, and that cooperates with said base wall to define a receiving space which opens upward;

said flexible body has two side segments that are respectively connected to said short edges of said surrounding wall, and opposite front and rear segments that are respectively connected to said long edges of said surrounding wall and that interconnect said side segments; and said telescopic rod unit and said foldable support are respectively disposed on said side segments of said flexible body, such that when said telescopic rod unit is substantially upright with respect to said base and when said foldable support is in the unfolded state, said flexible body is expanded to transform said collapsible luggage to an expanded state, and that when said telescopic rod unit is folded and received in the receiving space and when said foldable support is in the folded state, said flexible body is collapsed to transform said collapsible luggage to a collapsed state.

* * * * *